US005774919A

United States Patent [19]

Rich

[11] Patent Number: 5,774,919

[45] Date of Patent: Jul. 7, 1998

[54] COMBINATION POWER DRILL HANGER AND TOOL

[76] Inventor: Robert L. Rich, 13371 Lucille St., Garden Grove, Calif. 92644

[21] Appl. No.: 579,856

[22] Filed: Dec. 26, 1995

[51] Int. Cl.[6] ..... B25G 1/00

[52] U.S. Cl. ..... 7/167; 248/339; 81/16

[58] Field of Search ..... 248/339; 192/41 R; 81/16, 60; 7/167

[56] References Cited

U.S. PATENT DOCUMENTS

| | | | |
|---|---|---|---|
| 2,693,864 | 11/1954 | Ferro | 248/339 X |
| 4,100,637 | 7/1978 | Grieser et al. | 7/167 X |
| 5,179,748 | 1/1993 | Lipic | 7/167 X |

*Primary Examiner*—James G. Smith
*Attorney, Agent, or Firm*—Chris Papageorge

[57] ABSTRACT

The combination hanger and tool includes a stem which is provided at one end with a laterally enlarged structure and at the other end with a box end wrench (or other type of tool) having an aperture at the outer end thereof. The combination hanger and tool fits within the chuck of an electric drill with the lateral surfaces of the stem in engagement with the jaws of the chuck. The inner ends of the jaws are positioned adjacent the laterally enlarged structure which functions as a stop to prevent undesired relative movement between the stem and the jaws and thereby prevent separation of the combination hanger and tool from the chuck. When secured to the chuck, the aperture of the wrench is dimensioned to fit over a hook or peg thereby enabling the combination hanger and tool with the drill secured thereto to be hung from the hook or peg on a wall or other external structure. For chucks which require a key for operation thereof, one embodiment includes a chuck key mounted on the stem.

8 Claims, 6 Drawing Sheets

COMBINATION POWER DRILL HANGER AND TOOL

BACKGROUND OF THE INVENTION

The invention relates generally to tools and tool accessories. More particularly, the invention relates to a tool accessory which may be used to hang a power drill from a hook or peg affixed to wall and which may also be used as a manual tool as well as a drill chuck key.

Many tools such as wrenches, pliers and the like may be hung on a suitably designed wall overlay structure provided with hooks or pegs suitably dimensioned and positioned for accomodating such tools. These hand tools may thus be placed off the workbench or generally out of the immediate work area when not being used. However, in contrast, electric power drills are typically rather large and heavy pieces of power equipment which are not provided with a means for placing them off the workbench and out of the way when not in use. But, due to the variability in the size and dimensioning of power drills as well as their weight and bulk, such wall overlay structures are not typically provided with hooks or pegs which are positioned to accomodate hanging of power drills therefrom. Consequently, the user must usually pack the drill away when it is not in use or simply leave it lying on the workbench or in another part of the work area where it may be in the way of performance of other work or may be subject to damage or liable to damage something else by moving parts thereof if inadvertently turned on or to cause damage by sharp edges thereof or through other means. Thus, this shortcoming of modern power drill designs requires the user to expend extra work to retrieve and pack away the drill whenever he desires to use or discontinue use of it.

Designers of power drills have recognized that a major shortcoming of power drills which require a chuck key is that the chuck key is often separated from the drill and misplaced necessitating that the user expend often an excessive amount of time to search and retrieve it. An example of a chuck key designed for suspension thereof from an external structure is set forth in U.S. Pat. No. 4,634,321 to McClelland. The McClelland chuck key is used with an extension member which receives the chuck key and has an aperture for receiving the ball end of a cable for hanging the combination. Alternatively, the aperture may receive a hook to hang the combination. But, the McClelland invention is not capable of allowing both the drill and chuck key together to be hung therefrom.

Another prior art chuck key design which may allow hanging thereof from an external structure is disclosed in U.S. Pat. No. 326,036 to Anderson. The Anderson chuck key has an aperture at the center thereof which may perhaps allow the chuck key to be positioned on a hook or peg and hung therefrom. However, there is no provision in the Anderson chuck key design for the key to be attached to the drill in such a manner as to enable the drill to be hung or held by the key. Consequently, as with the McClelland design, such a design is not capable of allowing the hanging of both the drill and chuck key together from an external structure.

Consequently, what is needed is a tool accessory that allows a power drill to be hung from an external structure without damaging, causing excessive wear to or placing undue strain on the drill or components thereof. Such a tool accessory is also needed which may be manually attached and detached to and from the drill simply and easily. What is also needed is a power drill accessory which may also be used to both hang a power drill therefrom and simply as a manual tool per se.

SUMMARY OF THE INVENTION

It is a principal object of the present invention to provide a tool accessory for allowing a power drill to be hung from an external structure.

It is also an object of the present invention to provide a tool accessory for allowing a power drill to be hung from an external structure and which may also be used as a drill chuck key.

It is also an object of the present invention to provide a tool accessory for allowing a power drill to be hung from an external structure and which may also be used as a manual tool per se.

It is an object of the present invention to provide a tool accessory for allowing a power drill to be hung from an external structure and which may also be used as a drill chuck key and as a manual tool per se.

It is an object of the present invention to provide a tool accessory for a power drill which may be used to hang the power drill from an external structure and which may be manually attached and detached from the power drill.

It is an object of the present invention to provide a tool accessory for a power drill which may be used to hang the power drill from an external structure and which is simple and easy to use.

It is an object of the present invention to provide a tool accessory for a power drill which may be used to hang the power drill from an external structure and which does not cause undue wear to or place undue strain on the drill or components thereof.

It is an object of the present invention to provide a tool accessory for a power drill which may be used to hang the power drill from an external structure and which is inexpensive to manufacture.

It is an object of the present invention to provide a tool accessory for a power drill which may be used to hang the power drill from an external structure and which is structurally simple and compact so as to minimize the total number of parts and total amount of bulk of the power drill and accessories combination.

Basically, the combination power drill hanger and tool of the present invention is specifically designed to allow the power drill to be hung from a hook or peg which is mounted on a suitable wall overlay board or simply a wall or other suitable structure. In order to achieve this goal, the combination hanger and tool is provided with a stem which is dimensioned to allow its insertion into the chuck of the drill so that the chuck jaws may be clamped onto the stem thereby securing the stem to the drill. An outer member is attached to the stem at its outer end and is provided with an aperture for receiving the hook or peg therein and allowing the combination hanger and tool with drill secured thereto to be hung from the hook or peg. This also allows the power drill accessory to be hung solely from the hook so that the power drill accessory may be placed on its own hook in a known location where it is both out of harms way and easily retrievable when needed.

In order to ensure that the stem (and outer member) does not slip out of the chuck, a stop structure is provided at the lower end of the stem. The stop structure limits the movement of the stem in a direction outwardly from the chuck when it is secured to the drill via the chuck and hung from the hook or peg. Thus, in the event the chuck jaws are not adequately clamped onto the stem and/or the weight of the power drill acting on the stem is excessive, the stem will not slide along the jaws to the extent that it slides out of the chuck resulting in separation of the stem from the drill chuck and allowing the drill to fall from the external structure onto which it was hung. In order to so limit the undesired relative movement of the stem and chuck jaws, the stop structure is laterally dimensioned so that it is thicker than the stem. Thus, the difference in relative thickness of the stem and stop structure enables the stop structure to come up against the lower ends of the jaws upon outward movement of the stem relative to the jaws thereby blocking further movement of the stem relative to the jaws.

The outer member may be a wrench or any other kind of suitable hand tool which has an aperture dimensioned and shaped for allowing hanging of the tool and stem attached thereto to a hook or peg. This enhances the utility of the invention by enabling it to be used as a tool when it is not being used to hang the power drill and not secured to the chuck.

In order to accomodate power drills which require a chuck key for operation of the chuck, another embodiment of the invention includes a chuck key gear which is mounted on the stem. This enables the combination hanger and tool to be used as a chuck key with the stem and outer member together functioning as a handle for the chuck key gear. The stem and outer member are preferably dimensioned so that together they are of sufficient length that they provide increased leverage to the chuck key to enhance manual application of torque thereto.

DETAILED DESCRIPTION OF THE PREFERRED EMBODIMENT

Figure 1:
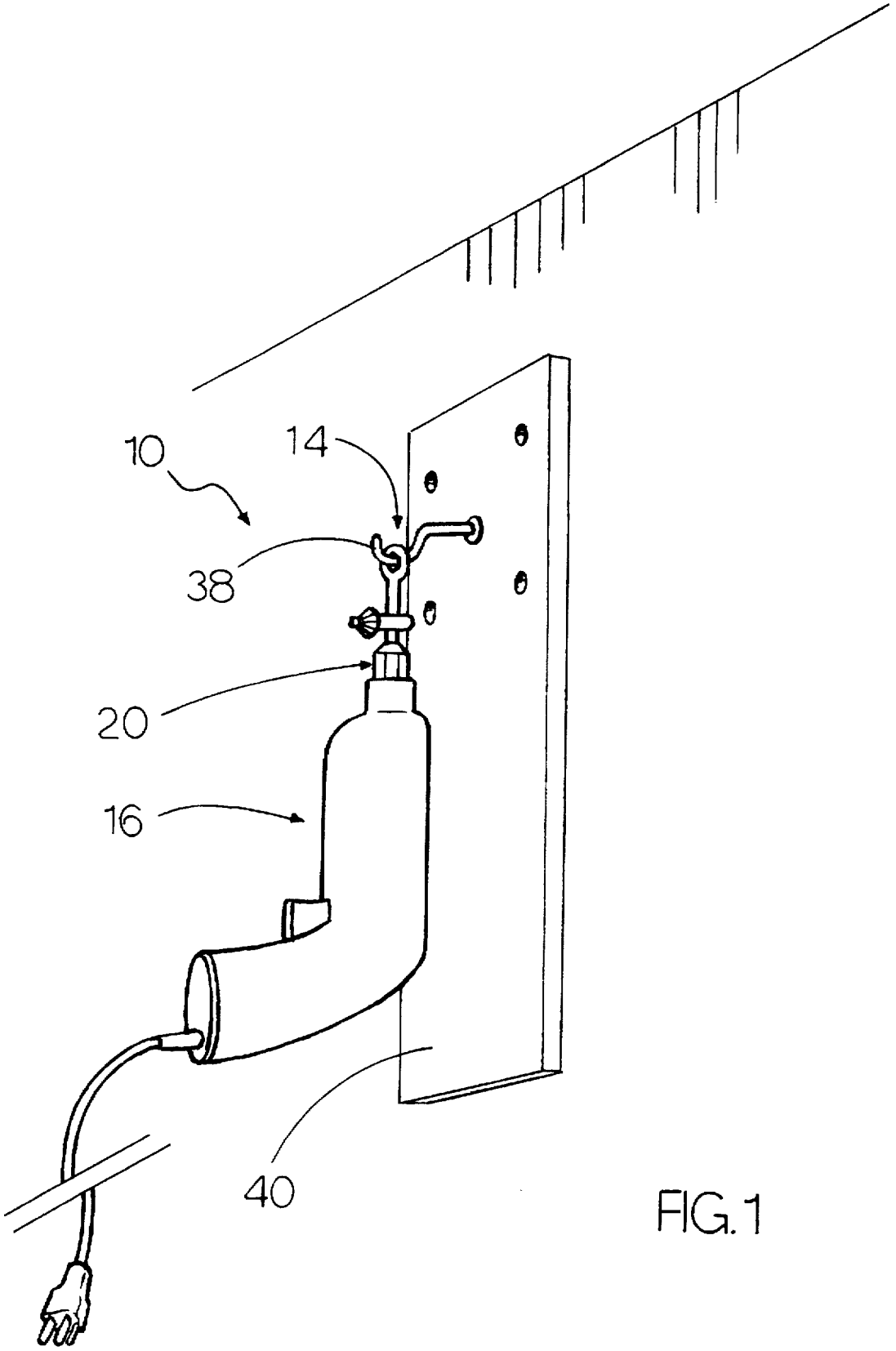
FIG. 1 is a perspective view of a first embodiment of the combination power drill hanger and tool shown hanging with power drill attached thereto from a hook on a wall structure.

Basically, the present invention is a power drill accessory which allows the power drill to be hung from a hook or peg mounted on a wall overlay, on another suitable structure or simply on a wall. In a first embodiment of the invention generally designated by the numeral 10, the power drill accessory 10 also incorporates a tool 14 which provides a dual function to the power drill accessory 10 enabling it to allow a power drill 16 to be hung therefrom (as shown in FIG. 1) as well as allowing the power drill accessory 10 to be utilized as a hand tool when it is not being utilized to hang the power drill 16. Thus, the drill accessory 10 is essentially a power drill hanger and tool in combination.

Figure 2:
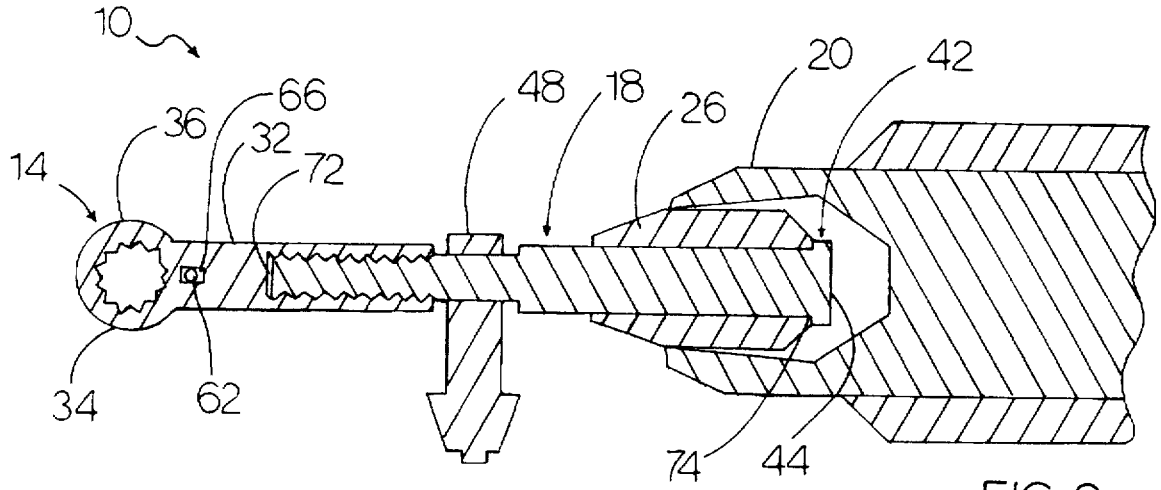
FIG. 2 is a longitudinal sectional view of the first embodiment shown secured to the chuck of the power drill and illustrating the positioning of components of the first embodiment relative to the chuck jaws.

The drill accessory (or combination power drill hanger and tool) 10 includes a stem 18 which is preferably generally elongate and preferably generally cylindrical. The stem is also preferably longitudinally and diametrically dimensioned so that it fits within a generally standard size chuck 20 of the power drill 16, as shown in FIG. 2. The stem 18 is thus preferably approximately three and three-eighths inches in longitudinal dimension and preferably approximately three-tenths of an inch in diameter at a inner portion 22 thereof and preferably one-fourth of an inch at an outer portion 24 thereof. The inner portion 22 is preferably dimensioned so that it is approximately one and seven-eighths inches in longitudinal length. The inner portion 22 is thus dimensioned so that it fits within the chuck 20 and engages the jaws 26 thereof when the chuck jaws 26 are tightened onto the inner portion 22 of the stem 18.

Figure 3:
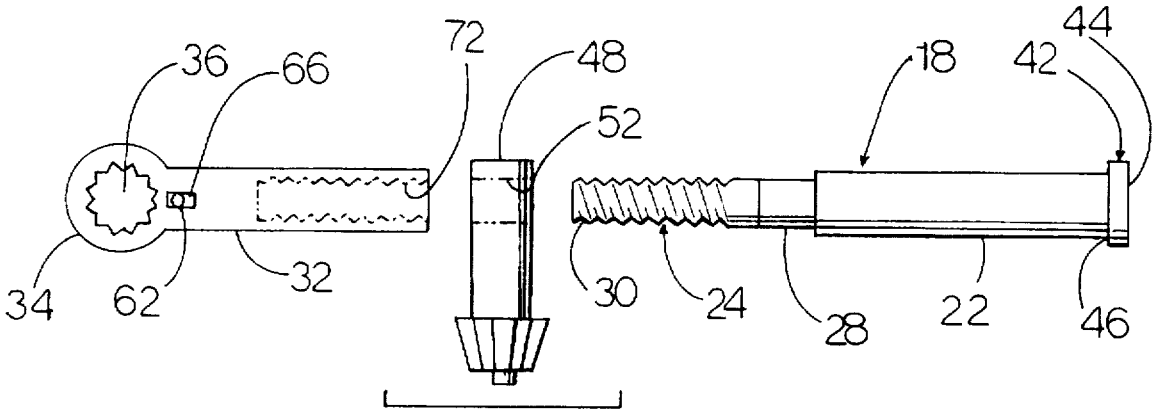
FIG. 3 is a partial exploded view of the first embodiment showing the main components thereof.

The outer portion preferably includes a medial portion 28 and an outer end portion 30 which is threaded in order to fit within a correspondingly threaded recess 72 of an outer member 32, as shown in FIGS. 2 and 3. The outer member 32 has an end portion 34 which has an aperture 36 therein which is dimensioned so that a hook 38 may fit therein. The aperture 36 is preferably closed on all lateral sides thereof in order to more securely retain the hook 38 therein. Alternatively, the aperture 36 may also be open at one side thereof in order to facilitate insertion of the hook 38 therein and removal of the hook 38 therefrom. The hook 38 is preferably secured to a wall overlay board 40 which has holes therein for selective placement of the hooks 38 or secured directly to a wall. This enables the drill accessory 10 with power drill 16 attached thereto to be hung from the hook 38 and thereby mounted on a wall. Alternatively, the outer member 32 by means of the aperture 36 may be hung from a peg or any other type of suitable elongate structure rather than the hook 38 described. The diameter of the aperture 36 is preferably approximately three-eighths of an inch in order to accomodate standard size hooks and pegs such as are typically used to hang tools therefrom.

Figure 5A:
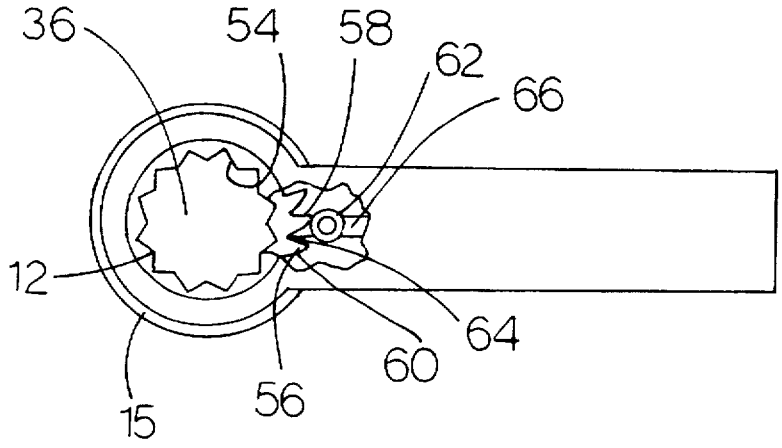
FIG. 5A is a side view of the outer member component of the first embodiment with a cut away portion illustrating the teeth of the ratchet member.
Figure 5B:
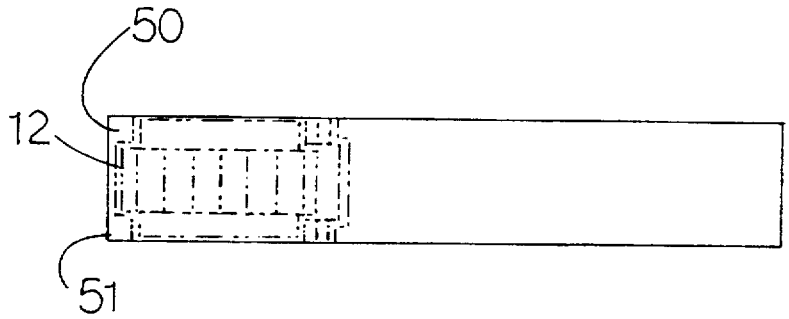
FIG. 5B is a top view of the outer member component of the first embodiment showing the ratchet member and pin components thereof sandwiched between the tool component's upper and lower members.
Figure 5C:
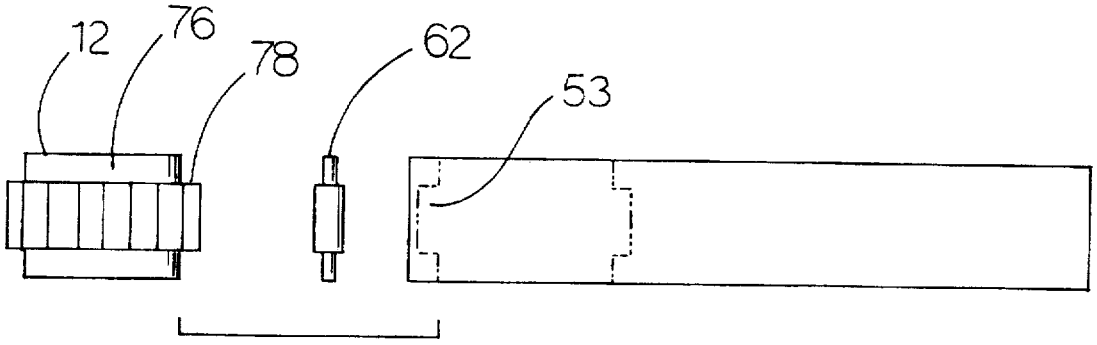
FIG. 5C is an exploded view of the outer member component of the first embodiment showing the pin components thereof in more detail.

The tool 14 preferably includes a ratchet wrench tool 15 shown in detail in FIGS. 5A, 5B and 5C. The ratchet wrench tool 15 is preferably integral with the outer member 32 and preferably includes a ratchet member 12 rotatably mounted within a recess 53 of the outer tool 15 and also preferably sandwiched between the upper and lower members 50 and 51 of the outer tool 15. The ratchet member 12 preferably includes an inner surface 54 which defines the aperture 36 and which is preferably hexagonally shaped so that it can fit around a suitably dimensioned nut or bolt enabling it to function as tool 14. The ratchet member 12 also is provided with teeth 56 at the outer portion thereof which have radially straight surfaces 58 at certain of the sides thereof and curved surfaces 60 at the other sides thereof. The outer member 32 preferably also includes a pin 62 which is longitudinally moveable within a slot 66 within the outer member 32. The pin 62 is preferably composed of a magnetic material (preferably a permanent magnet). The ratchet member 12 is preferably a two piece structure with an inner member 76 and an outer member 78 preferably press fitted together. The inner member 76 is preferably composed of a ferrous material to produce a force of attraction between the pin 62 and the inner member 78 to draw the pin 62 into the pocket 64 between the surfaces 60 and 58 to lock the ratchet member 12 and prevent it from rotating in a certain direction. The outer member 78, however, is preferably of a nonferrous material to prevent sticking of the pin in the pocket 64. When the ratchet member 12 is rotated (during use as a tool on a bolt head or other suitable workpiece), the curved surfaces 60 allow the pin 62 to slide along the curved surfaces 60 while the straight surfaces 58 due to their radial orientation do not allow the pin 62 to slide along the straight surfaces 58 and out of the pocket 64 thereby preventing rotation in the opposite direction and providing the desired ratcheting function to ratchet wrench or outer tool 15. The remainder of the outer member 32 not including the inner member 76 of ratchet member 12 and pin 62 are preferably composed of a nonferrous material in order to preclude interference with the motion of the pin 62 within the slot 66.

A stop structure 42 is positioned at the inner end portion 44 of the inner portion 22 of the stem 18. The stop structure 42 is dimensioned so that it is laterally larger than the inner portion 22 of the stem 18 i.e., the stop structure 42 is thicker than the inner portion 22 of the stem 18. The stop structure 42 is preferably approximately thirty-four hundredths of an inch in diameter. The stop structure 42 is preferably cylindrically shaped as is the stem 18 and preferably provided with a ridge (or lateral outer portions) 46 which protrudes laterally from the stem 18. The stop structure 42 and, more specifically, the ridge 46 is provided to engage the jaws 26 (as shown in FIG. 2) and, more specifically, the lower ends 74 of the jaws 26 in order to restrict or limit movement of the stem 18 relative to the chuck 20 in a direction generally outwardly therefrom when the drill accessory 10 is secured to the chuck 20. The stop structure 42 thus thus enables the power drill 16 to be more securely hung from the hook 38 by means of the drill accessory 10. Although the stop structure 42 has been described as cylindrically shaped and provided with a ridge 46, the stop structure 42 may alternatively be generally spherical or be any other suitable shape.

A chuck key gear 48 is mounted on the stem 18 and utilized for operation of the chuck 20. The chuck key gear 48 is preferably located at a medial portion 28 of the stem 18. The medial portion 28 is preferably diametrically smaller than the inner portion 22 of the stem 18 so that when the gear 48 is mounted on the medial portion 28 it is retained in position by the thicker inner portion 22. The gear 48 has a hole 52 at its central portion in order to be fitted onto the medial portion 28. The hole 52 is a little larger than the diameter of the medial portion 28 to enable the gear 48 to be free to rotate about the medial portion 28. This rotational mounting feature of the gear 48 enables the user to rotate the gear 48 so that it clears the overlay board 40 when it together with the power drill 16 are hung therefrom and also so that it clears the workpiece when it is used as a tool. The diameter of the hole is preferably approximately two hundred and fifty-four thousandths of an inch while the diameter of the medial portion 28 is preferably approximately twenty-five hundredths of an inch in order to provide the preferred clearance between the gear 48 and the medial portion 28.

The outer member 32 is preferably elongate and more preferably one and five-eighths inches in length. The particular length of the outer member 32 is selected so that the outer member 32 in combination with the stem 18 is of sufficient length to function as a handle for the chuck key gear 48. Thus, the outer member 32 and stem 18 in combination are of sufficient length to allow a sufficient degree of manual application of torque to the chuck key gear 48 in order to facilitate user operation of the chuck 20.

Figure 4:
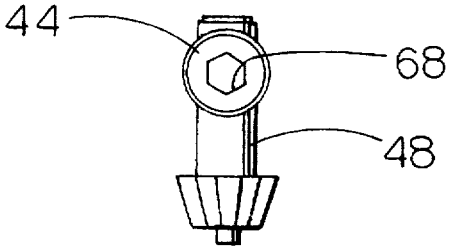
FIG. 4 is an end view of the first embodiment showing the socket fitting therein used for attachment and detachment of the outer member component from the stem component.

FIG. 4 shows an allen wrench socket fitting 68 which is securely mounted in the inner end portion 44 of the stem 18 in order to receive an allen wrench therein and allow the user to rotate the stem 18 relative to the outer member 32 while holding the outer member 32. This allows the outer member 32 to be removed by the user and another outer member incorporating another tool to be installed on the stem 18 thereby allowing various types of tools to be used with the tool accessory 10, if desired.

Figure 6:
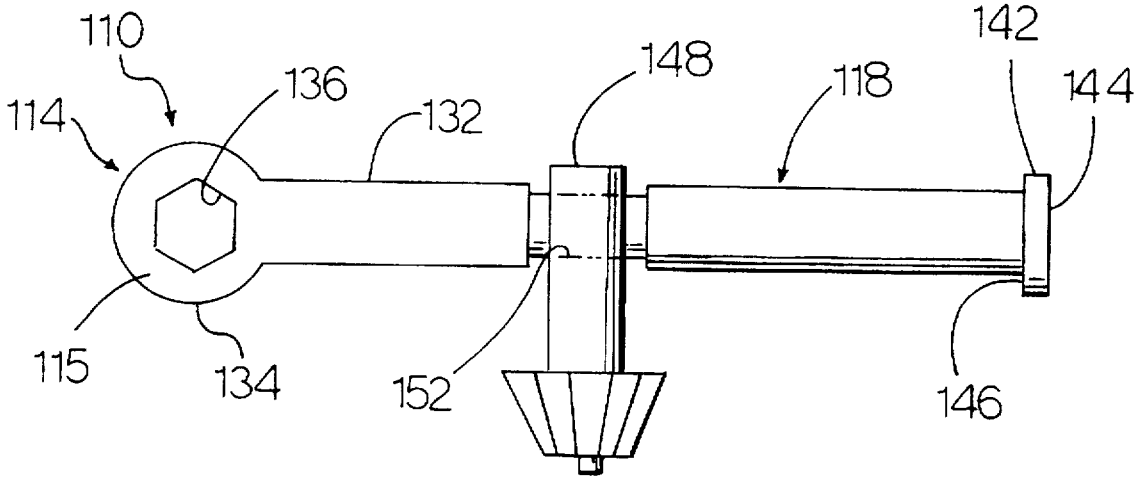
FIG. 6 is a side elevational view of a second embodiment of the combination power drill hanger and tool similar to the first embodiment except that some of the components thereof are unitary and the tool component is a box wrench.
Figure 7:
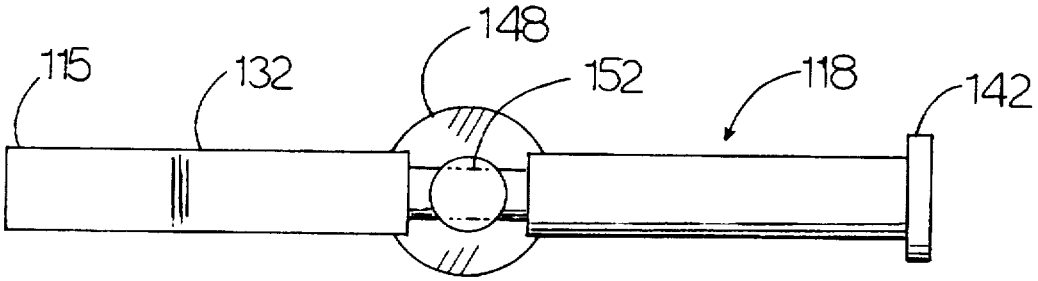
FIG. 7 is a top elevational view of the second embodiment.

A second embodiment 110 of the invention is depicted in FIGS. 6 and 7. The second embodiment 110 is essentially identical to the first embodiment 10 except that the outer member 132 and stem 118 are unitary and integral and the inner end portion 144 does not have an allen wrench fitting (as does the first embodiment 10) because the outer member is not rotatable relative to the stem 118. Consequently, embodiment 110 does not have the interchangeable tool feature of the first embodiment 10. In addition, the tool 114 of the second embodiment 110 comprises a simple box end wrench tool 115 rather than the ratchet wrench tool 15 incorporated in the first embodiment 10.

The second embodiment 110 includes a stem 118 having inner, outer, medial and outer end portions 122, 124, 128 and 130 thereof. Embodiment 110 also includes outer member 132 having end portion 134 and aperture 136. A stop structure 142 is provided on the inner end portion 144 and the stop structure includes a ridge 146. A chuck key gear 148 is rotatably mounted on the medial portion 128 via hole 152. The components of embodiment 110 are identical to and function the same as correspondingly numbered components of the first embodiment 10 which are described hereinabove.

Figure 8:
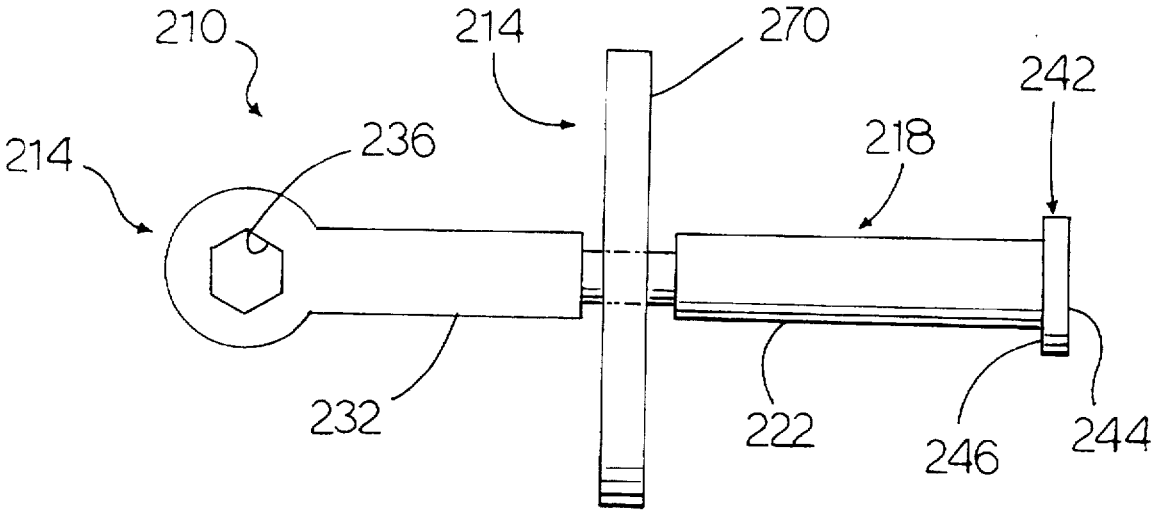
FIG. 8 is a side elevational view of a third embodiment of the combination power drill hanger and tool similar to the first embodiment except that the chuck key gear component incorporated in the first and second embodiments is omitted and a drill plate is substituted therefor.
Figure 9:
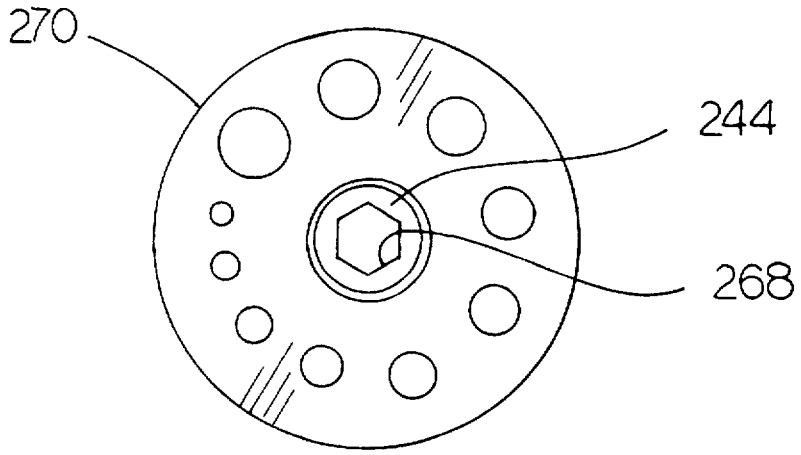
FIG. 9 is an end view of the third embodiment showing the allen wrench socket fitting and the face of the drill bit size plate component.
Figure 10:
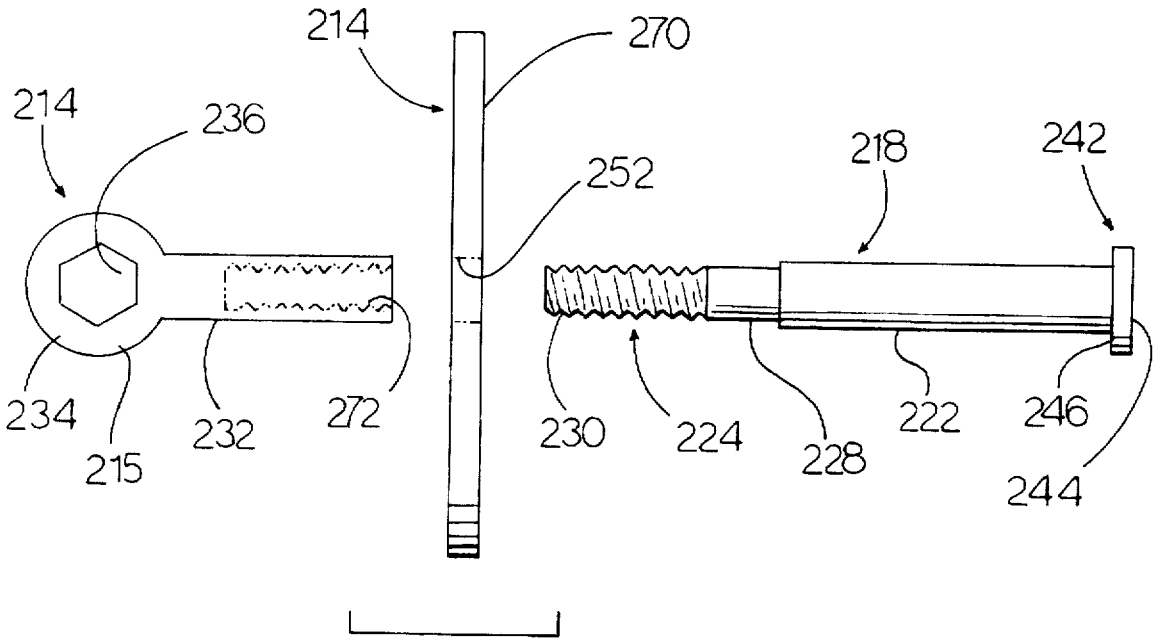
FIG. 10 is an exploded view of the third embodiment.

A third embodiment 210 of the invention is depicted in FIGS. 8, 9 and 10. The third embodiment 210 is specifically designed for use with power drills which incorporate a keyless chuck. The third embodiment 210 is essentially identical to the first embodiment 10 except that the chuck key gear 48 incorporated in the first embodiment 10 is not included while a drill bit size plate 270 is incorporated instead and mounted on the medial portion 228. Thus, a second tool 170 for enabling the user to check drill bit sizes is essentially substituted for the chuck key gear 48 utilized in embodiment 10. The third embodiment 210 is also dissimilar from the first embodiment 10 while similar to the second embodiment 110 in that a box end wrench tool 215 is incorporated as with embodiment 110 rather than the ratchet wrench tool 15 incorporated in embodiment 10. The tool 214 of embodiment 210 thus includes both drill bit size plate 270 and ratchet wrench 215.

The third embodiment 210 includes a stem 218 having inner, outer, medial and outer end portions 222, 224, 228 and 230 thereof. Embodiment 210 also includes outer member 232 having end portion 234 and aperture 236. A stop structure 242 is provided on the inner end portion 244 and the stop structure includes a ridge 246. The outer member 232 has a threaded recess for receiving correspondingly threaded outer end portion 230. An allen wrench socket fitting 268 is mounted at the inner end portion 244 of the stem 218 to allow the outer member to be screwed onto and unscrewed from the stem 218, as with embodiment 10. The components of embodiment 210 are identical to and function the same as correspondingly numbered components of the first and second embodiments 10 and 110 which are described hereinabove.

Accordingly, there has been provided, in accordance with the invention, a tool accessory for a power drill which attaches to the power drill and allows the power drill with tool accessory attached thereto to be together hung from a hook and which may be used as a tool separately from the power drill. The tool accessory of the present invention thus fully satisfies the objectives set forth above. Although the invention has been described in regard to power drills it may also be applied to other types of devices. It is to be understood that all terms used herein are descriptive rather than limiting. Although the invention has been described in conjunction with the specific embodiments set forth above, many alternative embodiments, modifications and variations will be apparent to those skilled in the art in light of the disclosure set forth herein. Accordingly, it is intended to include all such alternatives, embodiments, modifications and variation that fall within the spirit and scope of the invention set forth in the claims hereinbelow.

I claim:

1. A combination hanger for a drill having a chuck and tool, comprising:

a stem for insertion into the chuck of the drill and engagement with jaws thereof;

a wrench tool mounted at an end portion of said stem, said wrench tool having an aperture for receiving a hook or peg therein in order to enable the combination hanger and tool with drill attached thereto to be hung therefrom on an external structure;

a chuck key gear mounted on said stem.

2. The combination hanger and tool of claim 1 wherein said wrench tool includes a box end wrench tool.

3. The combination hanger and tool of claim 1 wherein said wrench tool includes a ratchet wrench tool.

4. A hanger for a drill having a chuck, comprising:

a stem for removable insertion into the chuck of the drill and engagement with jaws thereof, said stem including a stop structure mounted at an end portion of said stem for engaging end portions of the jaws of the chuck of the drill to prevent undesired sliding movement of said stem relative to the jaws and thereby separation of the hanger from the chuck when the jaws are closed on the stem, said stop structure dimensioned to allow manual insertion of said stem into the chuck and manual removal of the stem therefrom when the jaws are open;

an outer member at an end portion of said stem, said outer member having an aperture for receiving a hook or peg therein in order to enable the hanger with drill attached thereto to be hung therefrom on an external structure, said outer member including a box end wrench tool.

5. A hanger for a drill having a chuck, comprising:

a stem for removable insertion into the chuck of the drill and engagement with jaws thereof, said stem including a stop structure mounted at an end portion of said stem for engaging end portions of the jaws of the chuck of the drill to prevent undesired sliding movement of said stem relative to the jaws and thereby separation of the hanger from the chuck when the jaws are closed on the stem, said stop structure dimensioned to allow manual insertion of said stem into the chuck and manual removal of the stem therefrom when the jaws are open;

an outer member at an end portion of said stem, said outer member having an aperture for receiving a hook or peg therein in order to enable the hanger with drill attached thereto to be hung therefrom on an external structure;

a drill bit size plate mounted on said stem.

6. A combination hanger for a drill having a chuck and tool, comprising:

a stem for insertion into the chuck of the drill and engagement with jaws thereof;

a box end wrench tool mounted at an end portion of said stem, said box end wrench tool having an aperture for receiving a hook or peg therein in order to enable the combination hanger and tool with drill attached thereto to be hung therefrom on an external structure, the aperture being a functional part of said box end wrench tool and dimensionally sized to and having walls defining the aperture which are shaped to engage a workpiece and perform a desired tool task thereon.

7. A combination hanger for a drill having a chuck and tool, comprising:

a stem for insertion into the chuck of the drill and engagement with jaws thereof;

a drill bit size plate tool mounted at an end portion of said stem, said drill bit size plate tool having an aperture for receiving a hook or peg therein in order to enable the combination hanger and tool with drill attached thereto to be hung therefrom on an external structure, the aperture being a functional part of said drill bit size plate tool and dimensionally sized to and having walls defining the aperture which are shaped to engage a workpiece and perform a desired tool task thereon.

8. A combination hanger for a drill having a chuck and tool, comprising:

a stem for insertion into the chuck of the drill and engagement with jaws thereof;

a ratchet wrench tool mounted at an end portion of said stem, said ratchet wrench tool having an aperture for receiving a hook or peg therein in order to enable the combination hanger and tool with drill attached thereto to be hung therefrom on an external structure, the aperture being a functional part of said ratchet wrench tool and dimensionally sized to and having walls defining the aperture which are shaped to engage a workpiece and perform a desired tool task thereon.

* * * * *